US011067026B2

(12) United States Patent
Kurita

(10) Patent No.: US 11,067,026 B2
(45) Date of Patent: Jul. 20, 2021

(54) ENGINE CONTROLLER, ENGINE CONTROL METHOD, AND MEMORY MEDIUM

(71) Applicant: TOYOTA JIDOSHA KABUSHIKI KAISHA, Toyota (JP)

(72) Inventor: Shunsuke Kurita, Mie-ken (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/036,061

(22) Filed: Sep. 29, 2020

(65) Prior Publication Data

US 2021/0140385 A1 May 13, 2021

(30) Foreign Application Priority Data

Nov. 7, 2019 (JP) ..... JP2019-202205

(51) Int. Cl.
*F02D 41/30* (2006.01)
*F02D 41/24* (2006.01)

(52) U.S. Cl.
CPC ..... *F02D 41/30* (2013.01); *F02D 41/2429* (2013.01); *F02D 2200/0404* (2013.01); *F02D 2200/0406* (2013.01); *F02D 2200/101* (2013.01)

(58) Field of Classification Search
CPC ..... F02D 41/30; F02D 41/2429; F02D 2200/0404; F02D 2200/101; F02D 2200/0406
See application file for complete search history.

(56) References Cited

U.S. PATENT DOCUMENTS 4,773,375 A * 9/1988 Okino ..... F02D 41/04 123/488
5,465,617 A 11/1995 Dudek et al.
5,537,981 A * 7/1996 Suedholt ..... F02D 41/187 123/478
6,244,241 B1 * 6/2001 Mamiya ..... F02D 41/2461 123/295
2011/0004422 A1 * 1/2011 Akagi ..... G01F 1/6965 702/46
2016/0363083 A1 12/2016 Matthews
2019/0085775 A1 * 3/2019 Won ..... F02D 13/0215
2020/0018253 A1 * 1/2020 Yamada ..... F02D 13/0234
2021/0054801 A1 * 2/2021 Yamada ..... F02D 41/222

FOREIGN PATENT DOCUMENTS

JP 2013-221418 A 10/2013

* cited by examiner

*Primary Examiner* — Carl C Staubach
(74) *Attorney, Agent, or Firm* — Oblon, McClelland, Maier & Neustadt, L.L.P.

(57) ABSTRACT

An engine controller, an engine control method, and a memory medium are provided. A second calculation process calculates an intake air amount without using a detected value of the intake air flow rate. A guard process sets a difference amount learning value as a learning reflected value when the difference amount learning value is less than or equal to an upper limit guard value and greater than or equal to a lower limit guard value. A calculation method switching process sets a sum of a second intake air amount and the learning reflected value as a calculated value of the intake air amount when it is determined that an intake air pulsation is great.

7 Claims, 7 Drawing Sheets

ENGINE CONTROLLER, ENGINE CONTROL METHOD, AND MEMORY MEDIUM

BACKGROUND

1. Field

The present disclosure relates to an engine controller that executes a fuel injection control of an injector by calculating an intake air amount of the engine and determining a fuel injection amount based on the calculated value.

2. Description of Related Art

Proper control of the air-fuel ratio (i.e., mass ratio of fuel to air) of air-fuel mixture burned in cylinders requires accurate determination of the intake air amount of the engine (i.e., the mass of intake air flowing into the cylinders). Known intake air amount calculation methods include three methods: a mass flow method (i.e., mass flow mode); a speed density method; and a throttle speed method. In the mass flow method, an intake air amount is calculated from an intake air flow rate detected by an air flow meter disposed in a section of an intake passage that is upstream of a throttle valve. In the speed density method, an intake air amount is calculated by detecting an intake pipe pressure with an intake pipe pressure sensor disposed in a section of an intake passage that is downstream of a throttle valve and using an intake air flow rate estimated based on the intake pipe pressure and an engine rotation speed. In the throttle speed method, an intake air amount is calculated from an intake air flow rate estimated based on a throttle opening degree and an engine rotation speed.

Normally, among these three calculation methods, the mass flow method most accurately calculates the intake air amount during steady operation of the engine. Since each cylinder of the engine intermittently draws intake air in accordance with opening and closing of the intake valve, the flow of intake air in the intake passage is accompanied by pulsation. Such intake air pulsation influences the detected value of the air flow meter. Thus, in engine operational zones of great intake air pulsation, the speed density method and the throttle speed method more accurately calculate the intake air amount than the mass flow method in some cases.

In this regard, Japanese Laid-Open Patent Publication No. 2013-221418 discloses an engine controller that calculates an intake air amount by switching the calculation method in accordance with the magnitude of intake air pulsation. Specifically, the engine controller calculates the intake air amount by the mass flow method when the intake air pulsation is small and calculates the intake air amount by the speed density method or the throttle speed method when the intake air pulsation is great.

SUMMARY

In the above-described engine controller, when the intake air pulsation is great, the intake air amount is calculated by the speed density method and the throttle speed method, which cannot calculate the intake air amount as accurately as the mass flow method when the intake air pulsation is small. Accordingly, a certain amount of decrease in the calculation accuracy is more likely when the intake air pulsation is great than when the intake air pulsation is small.

Aspects of the present disclosure will now be described.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In Example 1, an aspect of the present disclosure provides an engine controller that calculates an intake air amount of an engine and executes a fuel injection control of an injector by determining a fuel injection amount based on a calculated value of the intake air amount. The engine controller is configured to execute a first calculation process that calculates the intake air amount based on a detected value of an intake air flow rate obtained by an air flow meter and a second calculation process that calculates the intake air amount based on one of a detected value of an intake pipe pressure and a throttle opening degree without using the detected value of the intake air flow rate. A determination process determines whether an intake air pulsation in an intake passage of the engine is great. A learning process updates a difference amount learning value based on a difference amount by which a first intake air amount differs from a second intake air amount such that the difference amount learning value becomes close to the difference amount when the determination process determines that the intake air pulsation is not great. The first intake air amount is the calculated value of the intake air amount obtained by the first calculation process. The second intake air amount is the calculated value of the intake air amount obtained by the second calculation process. A guard value calculation process calculates an upper limit guard value and a lower limit guard value based on a state quantity that indicates a running state of the engine. A guard process sets the upper limit guard value as a learning reflected value when the difference amount learning value is greater than the upper limit guard value, sets the lower limit guard value as the learning reflected value when the difference amount learning value is less than the lower limit guard value, and sets the difference amount learning value as the learning reflected value when the difference amount learning value is less than or equal to the upper limit guard value and greater than or equal to the lower limit guard value. A calculation method switching process sets the first intake air amount as the calculated value of the intake air amount when the determination process determines that the intake air pulsation is not great and sets a sum of the second intake air amount and the learning reflected value as the calculated value of the intake air amount when the determination process determines that the intake air pulsation is great.

In the above-described engine controller, when the determination process determines that the intake air pulsation is not great, the first intake air amount calculated by the first calculation process using the mass flow method based on the detected value of the air flow meter is set as the calculated value of the intake air amount. In addition, the learning process learns, as the difference amount learning value, the amount by which the first intake air amount differs from the second intake air amount calculated by the second calculation process using the speed density method based on the intake pipe pressure or the throttle speed method based on the throttle open degree. When the determination process determines that the intake air pulsation is great, the value in which the learning result of the difference amount learning value is reflected on the second intake air amount calculated by the second calculation process by the speed density method or the throttle speed method without using the detected value of the air flow meter is set as the calculated value of the intake air amount.

In the above-described engine controller, whereas the difference amount learning value is learned when the intake air pulsation is small, the learning result of the difference amount learning value is reflected on the calculation of the intake air amount. In such a case, the difference amount learning value learned in a running state in which the difference between the first intake air amount and the second intake air amount is large may be reflected on the calculation of the intake air amount in a running state in which the difference is not so large. Even in such a case, in the above-described engine controller, the upper limit guard value and the lower limit guard value calculated in correspondence with the running state of the engine are used to reflect, on the calculation of the intake air amount when the intake air pulsation is great, the value in which the upper guard and the lower guard are given to the difference amount learning value. Thus, when the difference amount learning value learned in the running state in which the difference between the first intake air amount and the second intake air amount is large is reflected on the calculation of the intake air amount in the running state in which the difference is not so large, a decrease in the calculation accuracy of the intake air amount is limited. In such a manner, in the above-described engine controller, even if the intake air pulsation is great, the intake air amount is calculated more accurately than, for example, when the intake air amount is calculated directly using the speed density method or the throttle speed method.

In Example 2, for example, an engine rotation speed and an engine load may be set as the state quantity used for the guard value calculation process in the above-described engine controller. Alternatively, in Example 3, an engine rotation speed and the intake pipe pressure may be set as the state quantity used for the guard value calculation process. In Example 4, an engine rotation speed and the throttle opening degree may be set as the state quantity used for the guard value calculation process. In Example 5, the intake air flow rate may be set as the state quantity used for the guard value calculation process.

Example 6 provides an engine control method that executes the processes described in any one of Examples 1 to 5.

Example 7 provides a non-transitory computer readable memory medium that stores a program that causes a processor to execute the processes described in any one of Examples 1 to 5.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

An engine controller 30 according to an embodiment will now be described with reference to FIGS. 1 to 9. The engine controller of the present embodiment is employed in a vehicle-mounted engine 10.

Figure 1:
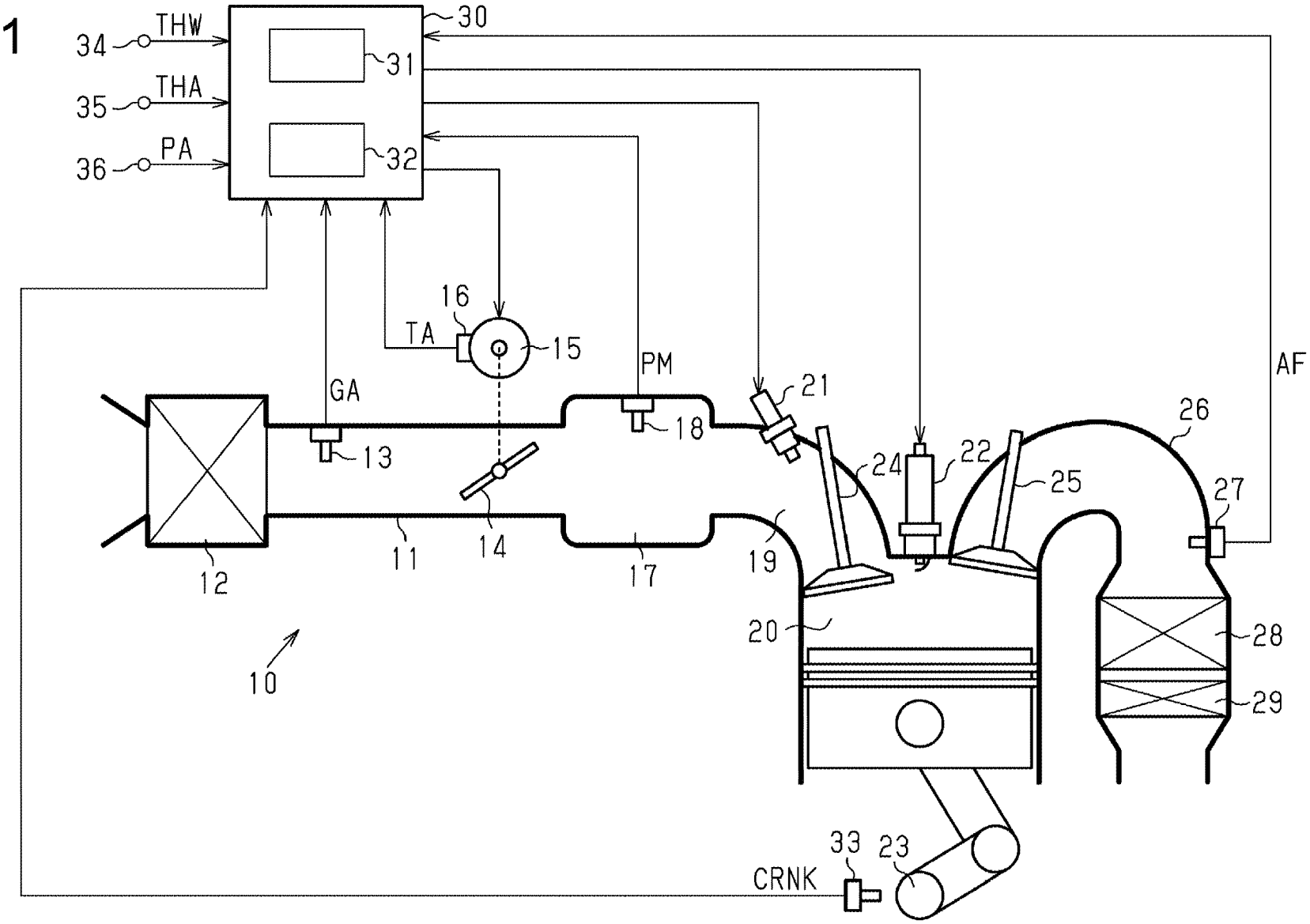
FIG. 1 is a schematic diagram showing an engine controller according to an embodiment.

First, the configuration of the engine 10, in which the engine controller 30 of the present embodiment is employed, will be described with reference to FIG. 1. The engine 10 includes a combustion chamber 20 for each of the cylinders, where air-fuel mixture is burned, an intake passage 11, through which intake air is drawn into the combustion chamber 20, and an exhaust passage 26, out of which exhaust gas flowing from the combustion chamber 20 is discharged. Each cylinder of the engine 10 includes an intake valve 24 and an exhaust valve 25. The intake valve 24 and the exhaust valve 25 open and close in cooperation with the rotation of a crankshaft 23, which is the output shaft of the engine 10. When the intake valve 24 opens, intake air flows from an intake port 19 to the combustion chamber 20. When the exhaust valve 25 opens, the exhaust gas generated by the combustion of the air-fuel mixture in the combustion chamber 20 is discharged to the exhaust passage 26.

The intake passage 11 of the engine 10 is provided with an air cleaner 12, which filters out impurities such as dust in the intake air delivered to the combustion chamber 20. The intake passage 11 is provided with an air flow meter 13 in a section downstream of the air cleaner 12. The air flow meter 13 detects an intake air flow rate, which is the mass flow rate of the intake air flowing through the intake passage 11. The intake passage 11 is provided with a throttle valve 14 in a section downstream of the air flow meter 13. In the vicinity of the throttle valve 14, a throttle motor 15 and a throttle sensor 16 are provided. The throttle motor 15 selectively opens and closes the throttle valve 14. The throttle sensor 16 detects the opening degree of the throttle valve 14. The opening degree of the throttle valve 14 will hereafter be referred to as a throttle opening degree TA. The intake passage 11 is provided with an intake manifold 17 in a section downstream of the throttle valve 14. The intake manifold 17 is a branch tube that distributes intake air into the cylinders of the engine 10. The intake manifold 17 is provided with an intake pipe pressure sensor 18. The intake pipe pressure sensor 18 detects an intake pipe pressure PM, which is the pressure of the intake air in the intake manifold 17. Each branch tube of the intake manifold 17 is connected to the combustion chamber 20 through the intake port 19 of the corresponding cylinder. The intake port 19 of each cylinder is provided with an injector 21, which injects fuel into intake air. Further, the combustion chamber 20 of each cylinder is provided with an ignition device 22. The ignition device 22 ignites, with spark discharge, air-fuel mixture of the intake air drawn in through the intake passage 11 and the fuel injected by the injector 21. The exhaust passage 26 of the engine 10 is provided with an air-fuel ratio sensor 27, which detects an air-fuel ratio AF of the air-fuel mixture burned in the combustion chamber 20. Further, the exhaust passage 26 is provided with a three-way catalyst device 28 in a section downstream of the air-fuel ratio sensor 27. The three-way catalyst device 28 reduces and purifies nitrogen oxide (NOx) in exhaust gas, while at the same time oxidizing hydrocarbon (HC) and carbon monoxide (CO) in exhaust gas. Further, the exhaust passage 26 is provided with a filter device 29 in a section downstream of the three-way catalyst device 28. The filter device 29 traps the particulate matter in exhaust gas.

The engine controller 30, which is employed in the engine 10, includes a CPU 31 and a ROM 32. The CPU 31 executes various calculation processes related to engine control. The ROM 32 stores programs and data for control. The engine controller 30 receives detection signals from the air flow meter 13, the throttle sensor 16, the intake pipe pressure sensor 18, and the air-fuel ratio sensor 27. The engine controller 30 also receives detection signals from, for example, a crank angle sensor 33, a water temperature sensor 34, an intake air temperature sensor 35, and an atmospheric pressure sensor 36. The crank angle sensor 33 detects a crank angle CRNK, which is the rotation angle of the crankshaft 23. The water temperature sensor 34 detects an engine water temperature THW, which is the temperature of engine coolant. The intake air temperature sensor 35 detects an intake air temperature THA, which is the temperature of intake air flowing through the intake passage 11. The atmospheric pressure sensor 36 detects an atmospheric pressure PA. The engine controller 30 calculates an engine rotation speed NE, which is the rotation speed of the crankshaft 23, from the detection result of the crank angle sensor 33. Based on the detection result of these sensors, the engine controller 30 determines the operation amounts of actuators such as the throttle motor 15, the injector 21, and the ignition device 22, controlling the running of the engine 10. The engine controller 30 executes various processes related to the control of the running of the engine 10 by the CPU 31 reading and executing the programs stored in the ROM 32.

Fuel Injection Amount Control

Figure 2:
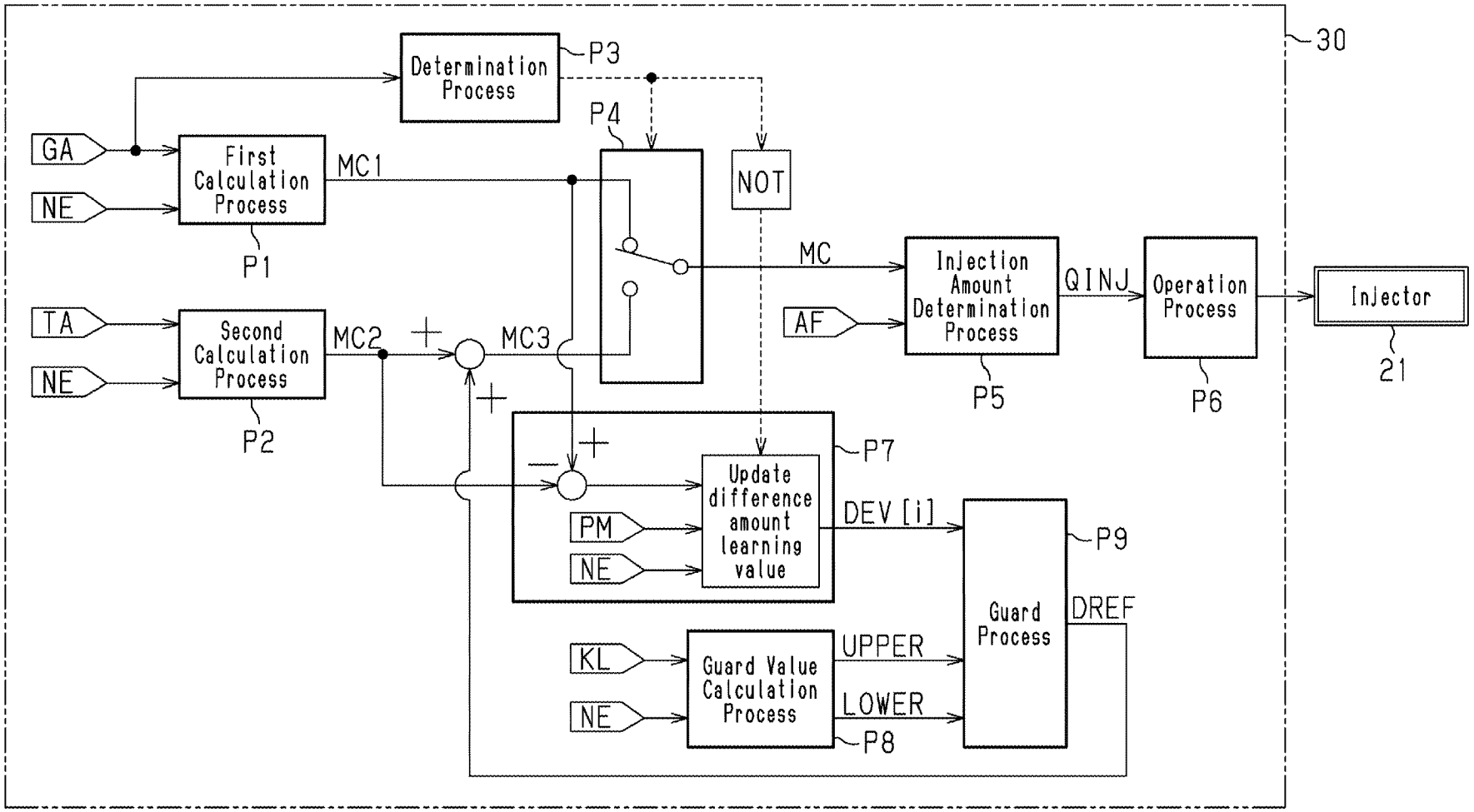
FIG. 2 is a control block diagram showing the flow of processes related to a fuel injection amount control executed by the engine controller.

The fuel injection amount control executed by the engine controller 30 as part of the control of the running of the engine 10 will now be described with reference to FIG. 2. The fuel injection amount control is executed through a first calculation process P1, a second calculation process P2, a determination process P3, a calculation method switching process P4, an injection amount determination process P5, an operation process P6, a learning process P7, a guard value calculation process P8, and a guard process P9.

As described above, in the engine 10, the three-way catalyst device 28 in the exhaust passage 26 purifies exhaust gas. The three-way catalyst device 28, which simultaneously oxidizes HC and CO in exhaust gas and reduces NOx, has the maximum exhaust purification capability when the air-fuel ratio of the air-fuel mixture burned in the combustion chamber 20 is a stoichiometric air-fuel ratio. In the injection amount determination process P5, the fuel injection amount in which the air-fuel ratio of the air-fuel mixture burned in the combustion chamber 20 is the stoichiometric air-fuel ratio is set as the value of an instructed injection amount QINJ. More specifically, in the injection amount determination process P5, first, an intake air amount calculation value MC, which is a calculated value of the mass of the intake air burned in the combustion chamber 20, is used to calculate, as the value of a basic injection amount QBSE, the quotient of the intake air amount calculation value MC divided by the stoichiometric air-fuel ratio. Further, in the injection amount determination process P5, the value obtained by correcting the basic injection amount QBSE through an air-fuel ratio feedback correction that corresponds to a difference between the stoichiometric air-fuel ratio and a detected value of the air-fuel ratio AF obtained by the air-fuel ratio sensor 27 is determined as the value of the instructed injection amount QINJ. In the operation process P6, the injector 21 of each cylinder is operated so as to inject the fuel corresponding to the value of the instructed injection amount QINJ that has been determined in the injection amount determination process P5.

The engine controller 30 of the present embodiment executes two processes, i.e., the first calculation process P1 and the second calculation process P2, to calculate the intake air amount used to determine the fuel injection amount in the injection amount determination process P5. In the first calculation process P1, the intake air amount is calculated by the mass flow method based on the engine rotation speed NE and an AFM-detected intake air flow rate GA, which is the detected value of the intake air flow rate of the air flow meter 13. In the second calculation process P2, the intake air amount is calculated by the throttle speed method based on the throttle opening degree TA and the engine rotation speed NE, without using the AFM-detected intake air flow rate GA. In the first calculation process P1 executed by the mass flow method, the intake air amount is calculated using, for example, the AFM-detected intake air flow rate GA and the engine rotation speed NE based on a relationship in which the AFM-detected intake air flow rate GA is equal to the total amount of intake air flowing into the combustion chamber 20 per unit time during steady operation of the engine 10. In the second calculation process P2 executed by the throttle speed method, the intake air amount is calculated by obtaining the differential pressure of intake air before and after passing through the throttle valve 14 and by using a throttle passage flow rate, which is calculated from the differential pressure and the throttle opening degree TA. The throttle passage flow rate indicates the volumetric flow rate of intake air passing through the throttle valve 14. The differential pressure of intake air before and after passing through the throttle valve 14 changes depending on the atmospheric pressure PA and the pressure of exhaust gas. To calculate the intake air amount from the volumetric flow rate of intake air passing through the throttle valve 14, that is, to calculate the mass of the intake air burned in the combustion chamber 20, a change in density resulting from the temperature of intake air needs to be taken into consideration. Thus, actually, in the second calculation process P2, the intake air is calculated in reference to, for example, the engine water temperature THW, the intake air temperature THA, and the atmospheric pressure PA in addition to the throttle opening degree TA and the engine rotation speed NE. In the following description, the value of the intake air amount calculated by the mass flow method in the first calculation process P1 will be referred to as a first intake air amount MC1, and the value of the intake air amount calculated by the throttle speed method in the second calculation process P2 will be referred to as a second intake air amount MC2.

In general, an intake air amount is calculated more accurately by the mass flow method than the throttle speed method. That is, the value of the first intake air amount MC1 is normally more accurate than that of the second intake air amount MC2. When the engine 10 is running, the intermittent flow of intake air into the combustion chamber 20 in response to opening and closing of the intake valve 24 generates pressure fluctuation in the intake port 19. When the pressure fluctuation in the intake port 19 passes through the throttle valve 14 upstream over the intake passage 11, the air pulsation of intake air may occur in a section of the intake passage 11 where the air flow meter 13 is provided. Such intake air pulsation may result in a decrease in the detection accuracy of the air flow meter 13. Thus, when the intake air pulsation is greater than a certain intake air pulsation, the calculation accuracy of the intake air amount may be lower in the throttle speed method, which calculates the intake air amount without using the AFM-detected intake air flow rate GA, than in the mass flow method, which calculates the intake air amount using the AFM-detected intake air flow rate GA.

The engine controller 30 of the present embodiment executes the determination process P3, which determines whether the intake air pulsation is great, and the calculation method switching process P4, which switches the method of calculating the intake air amount in accordance with the determination result of the determination process P3. In the calculation method switching process P4, when the determination process P3 determines that the intake air pulsation is not great, the first intake air amount MC1, which is calculated by the mass flow method, is set as the value of the intake air amount calculation value MC. In the calculation method switching process P4, when the determination process P3 determines that the intake air pulsation is great, the sum (MC2+DERF) of the second intake air amount MC2, which is calculated by the throttle speed method, and a learning reflected value DREF, which is set through the learning process P7, the guard value calculation process P8, and the guard process P9, is set as the value of the intake air amount calculation value MC.

Determination Process

Figure 3:
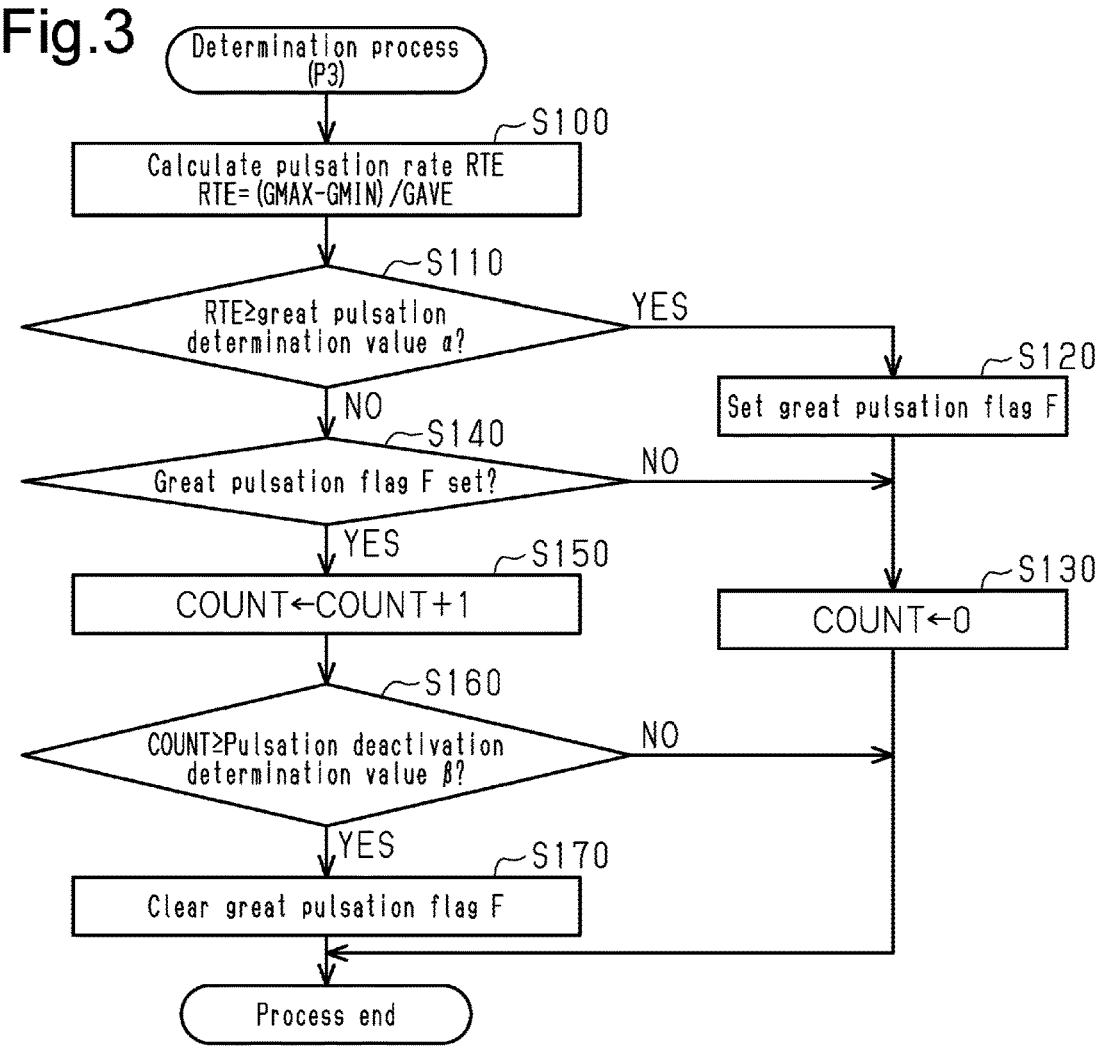
FIG. 3 is a flowchart of the determination process executed by the engine controller during the fuel injection amount control.
Figure 4:
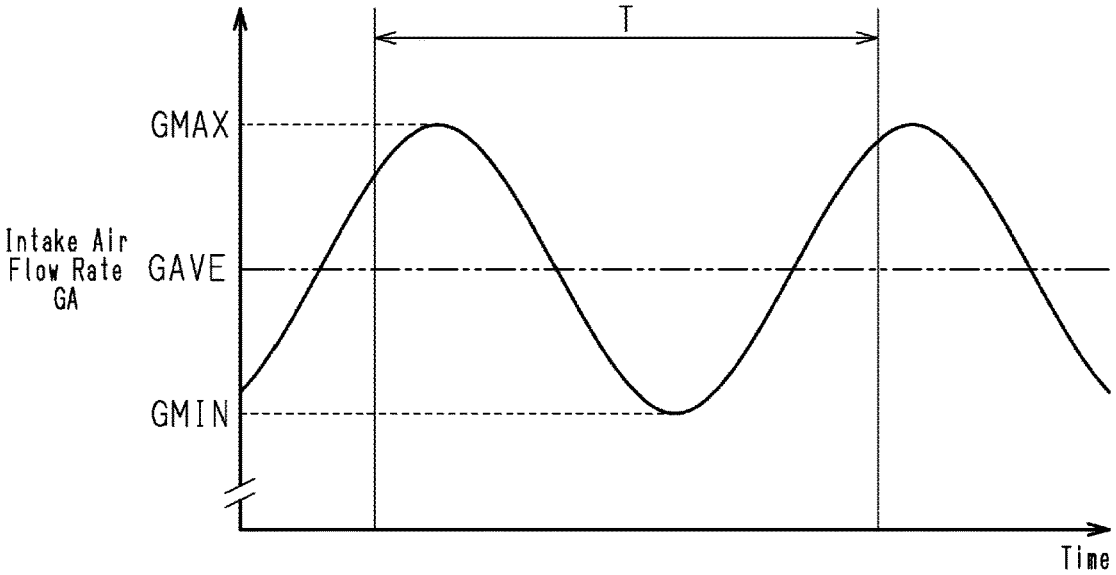
FIG. 4 is a graph illustrating a mode of calculating the pulsation rate used in the determination process.

The detail of the determination process P3 will now be described with reference to FIGS. 3 and 4. FIG. 3 shows a flowchart of the process executed repeatedly in preset control cycles while the engine 10 is running.

Once the determination process P3 in each control cycle is started, first, in step S100, a pulsation ratio RTE is calculated in step. FIG. 4 shows a maximum value GMAX, a minimum value GMIN, and an average value GAVE of the AFM-detected intake air flow rate GA in a preset period T. The pulsation ratio RTE is calculated as the quotient obtained by dividing, by the average value GAVE, the difference obtained by subtracting the minimum value GMIN from the maximum value GMAX ((GMAX−GMIN)/GAVE). The period T is set to be longer than the cycle of intake air pulsation.

Subsequently, it is determined in step S110 whether the value of the pulsation ratio RTE is greater than or equal to a preset great pulsation determination value α. When the value of the pulsation ratio RTE is greater than or equal to the great pulsation determination value α (S110: YES), the process is advanced to step S120. When the value of the pulsation ratio RTE is less than the great pulsation determination value α (S110: NO), the process is advanced to step S140.

When the value of the pulsation ratio RTE is greater than or equal to the great pulsation determination value α (S110: YES) and the process is advanced to step S120, a great pulsation flag F is set in step S120. Further, in this case, the value of a counter COUNT is reset to 0 in step S130. Then, the process of the current routine is ended. The great pulsation flag F indicates the determination result of the determination process P3. The great pulsation flag F is set when the intake air pulsation is great, and the great pulsation flag F is cleared when the intake air pulsation is not great.

When the value of the pulsation ratio RTE is less than the great pulsation determination value α (S110: NO), the process is advanced to step S140. In step S140, it is determined whether the great pulsation flag F has been set. When the great pulsation flag F has not been set (S140: NO), the process is advanced to step S130. In step S130, the value of the counter COUNT is reset to 0 and then the process of the current routine is ended. When the great pulsation flag F has been set (S140: YES), the process is advanced to step S150.

When the process is advanced to step S150, the value of the counter COUNT is incremented in step S150. Subsequently, it is determined in step S160 whether the incremented value of the counter COUNT is greater than or equal to a preset pulsation deactivation determined value β. When the value of the counter COUNT is less than the pulsation deactivation determined value β (S160: NO), the process of the current routine is ended. When the value of the counter COUNT is greater than or equal to the pulsation deactivation determined value β (S160: YES), the great pulsation flag F is cleared in step S170. Then, the process of the current routine is ended.

In the above-described determination process P3, when the value of the pulsation ratio RTE is increased from a value less than the great pulsation determination value α to a value greater than or equal to the great pulsation determination value α, the great pulsation flag F is switched from a cleared state to a set state. When the pulsation ratio RTE is less than the great pulsation determination value α and the value of the counter COUNT is greater than or equal to the great pulsation determination value α, the great pulsation flag F is switched from the set state to the cleared state. When the pulsation ratio RTE is less than the great pulsation determination value α and the great pulsation flag F has been set, the value of the counter COUNT is incremented. In other cases, the value of the counter COUNT is reset to 0. That is, the value of the counter COUNT starts to be incremented when the pulsation ratio RTE drops from a value greater than or equal to the great pulsation determination value α to a value less than the great pulsation determination value α, and then the value of the counter COUNT continues to be incremented until the pulsation ratio RTE becomes greater than or equal to the great pulsation determination value α or until the great pulsation flag F is cleared. The value of the counter COUNT is incremented each time the pulsation determination routine is executed. In addition, the pulsation determination routine is executed in each calculation cycle of the intake air amount. Accordingly, the great pulsation flag F is switched from the set state to the cleared state when the pulsation ratio RTE drops from a value greater than or equal to the great pulsation determination value α to a value less than the great pulsation determination value α and then the pulsation ratio RTE continues to be less than the great pulsation determination value α for a certain period of time. In the above-described calculation method switching process P4, the determination result of the determination process P3 is checked in reference to whether the great pulsation flag F has been set.

Learning Process

The detail of the learning process P7 will now be described with reference to FIGS. 5 to 7. In the learning process P7, when the determination process P3 determines that the intake air pulsation is not great, that is, when the great pulsation flag F is cleared, a process that updates the learning value of the amount in which the first intake air amount MC1 differs from the second intake air amount MC2 is executed.

Figure 5:
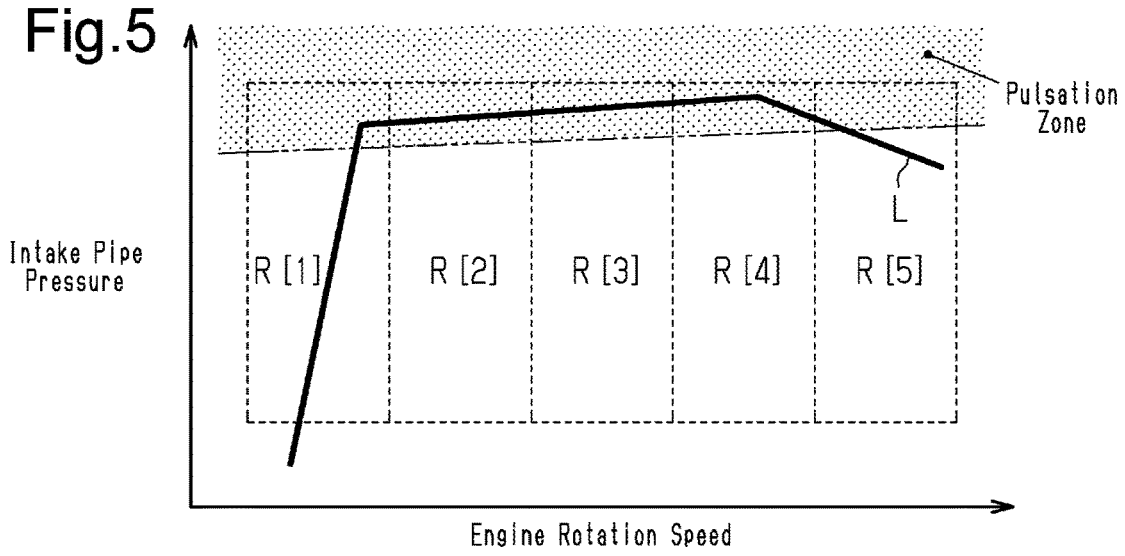
FIG. 5 is a graph illustrating the mode of setting a difference amount learning zone in the learning process executed by the engine controller.

In the present embodiment, the learning value of a difference amount is individually set to each of five difference amount learning zones divided by the engine rotation speed NE as shown in FIG. 5, namely, R[1], R[2], R[3], R[4], and R[5]. In the following description, the learning value of the deviation amount corresponding to the difference amount in a difference amount learning zone R[i] when i is 1, 2, 3, 4, or 5 is referred to as a difference amount learning value DEV[i].

In FIG. 5, line L represents the maximum value of the intake pipe pressure per engine rotation speed in the running zone of the engine 10. Further, the pulsation zone hatched in FIG. 5 represents a running zone of the engine 10 where a great intake air pulsation possibly occurs enough to decrease the detection accuracy of the air flow meter 13. When the throttle opening degree TA is small, the throttle valve 14 functions as a barrier that discontinues the ascending of pressure fluctuation of intake air from the intake port 19 toward the air flow meter 13 in the intake passage 11. Further, when the throttle opening degree TA is small, the flow of intake air is reduced by the throttle valve 14. This lowers the intake pipe pressure PM. Thus, the pulsation zone is a high-load zone of the engine 10 where the throttle opening degree TA is large and the intake pipe pressure PM is high.

Figure 6:
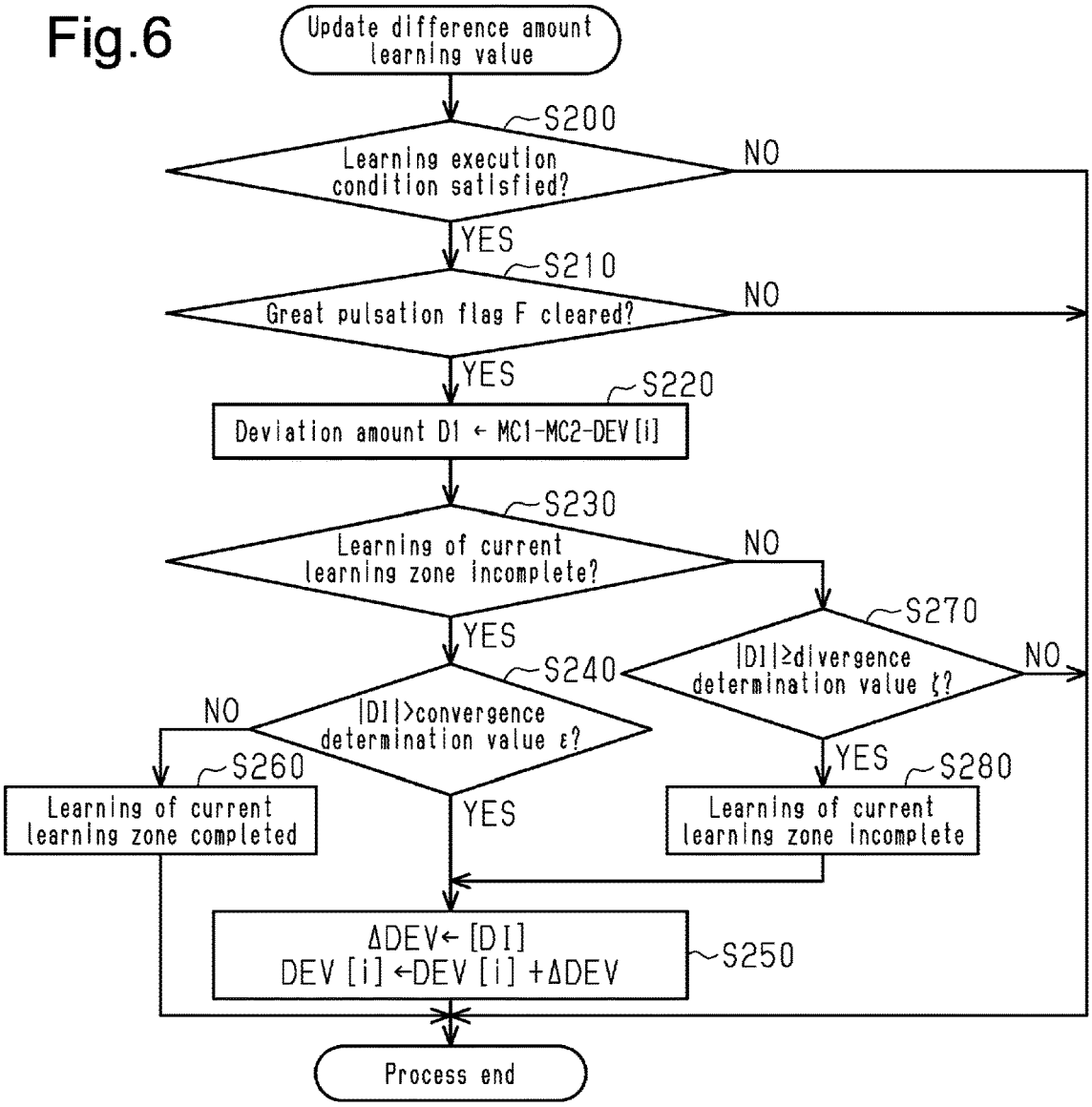
FIG. 6 is a flowchart of the process related to the update of the difference amount learning value in the learning process.

FIG. 6 shows a flowchart of the process related to the update of the difference amount learning value DEV[i] in the learning process P7. A series of processes shown in FIG. 6 are executed repeatedly in each preset control cycle while the engine 10 is running.

Once the process related to the learning process P7 in the current control cycle, first, it is determined in step S200 whether a learning execution condition has been satisfied. When the learning execution condition has not been satisfied (S200: NO), the process of the current routine is ended. The learning execution condition is met by satisfying all of the following conditions: (a) the engine 10 is running in any one of the difference amount learning zones R[1] to R[5]; (b) the engine 10 is not in a transient state in which the running condition of the engine 10 does not change; (c) warming-up of the engine 10 is completed; and (d) the systems of sensors and actuators have no anomalies.

When the learning execution condition has been satisfied (S200: YES), the process is advanced to step S210. In step S210, it is determined whether the great pulsation flag F has been cleared. That is, the determination process P3 determines whether the intake air pulsation is not great. When the great pulsation flag F has been cleared (S210: YES), the process is advanced to step S220. When the great pulsation flag F has been set (S210: NO), the process of the current routine is ended.

When the process is advanced to step S220, the difference obtained by subtracting the second intake air amount MC2 from the first intake air amount MC1 and then subtracting the difference amount learning value DEV[i] of the current learning zone from that difference (MC1−MC2−DEV[i]) is calculated as the value of a deviation amount DI in step S220. Subsequently, it is determined in step S230 whether the learning of the difference amount learning value DEV[i] in the current learning zone is incomplete. When the learning of the difference amount learning value DEV[i] in the current learning zone is incomplete (S230: YES), the process is advanced to step S240. When the learning is complete (S230: NO), the process is advanced to step S270.

When the learning in the current learning zone is incomplete and the process is advanced to step S240, it is determined in step S240 whether the absolute value of the deviation amount DI is greater than a preset convergence determination value ε. When the absolute value of the deviation amount DI is greater than the convergence determination value α (S240: YES), the process is advanced to step S250. When the absolute value of the deviation amount DI is less than or equal to the convergence determination value ε (S240: NO), the process is advanced to step S260. In step S260, the completion of the learning of the current learning zone is recorded and then the process of the current routine is ended.

When the process is advanced to step S250, the value of the difference amount learning value DEV[i] in the current learning zone is updated in correspondence with the deviation amount DI in step S250. After this update, the process of the current routine is ended. The value of the difference amount learning value DEV[i] is updated as follows. That is, the value of an update amount ΔDEV is first obtained from the deviation amount DI.

Figure 7:
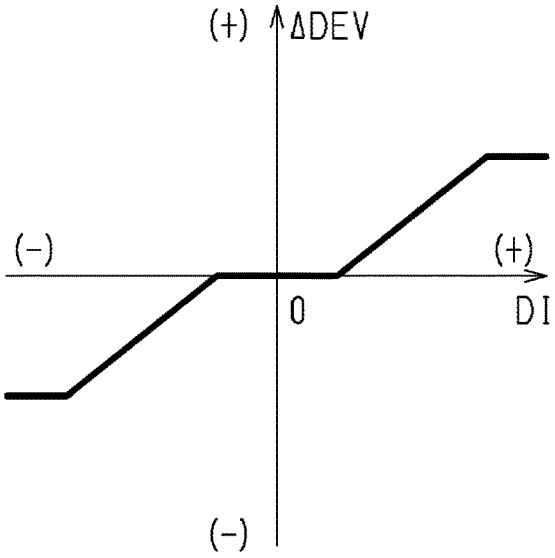
FIG. 7 is a graph illustrating the relationship between the update amount and the deviation amount of the difference amount learning value calculated in the learning process.

As shown in FIG. 7, the positive and negative values of the update amount ΔDEV are equal to those of the deviation amount DI. The deviation amount DI has a smaller absolute value than the update amount ΔDEV. Also, the update amount ΔDEV is set such that the absolute value of the update amount ΔDEV is larger when the and DI has a large absolute value than when the deviation amount DI has a small absolute value. That is, FIG. 7 shows a line segment extending upward and rightward with a small inclination in a graph where the vertical axis is the update amount ΔDEV and the horizontal axis is the deviation amount D1. The value of the difference amount learning value DEV[i] in the current learning zone is updated such that the sum of the difference amount learning value DEV[i] prior to being updated and the update amount ΔDEV becomes the value subsequent to being updated.

When the learning of the current learning zone is completed (S230: NO), the process is advanced to step S270. In step S270, it is determined whether the absolute value of the deviation amount DI is greater than or equal to a preset discrepancy determination value ζ. The discrepancy determination value ζ is set to be larger than the convergence determination value ε. When the absolute value of the deviation amount DI is less than the discrepancy determination value ζ (S270: NO), the process of the current routine is ended. When the absolute value of the deviation amount DI is greater than or equal to the discrepancy determination value ζ (S270: YES), the process is advanced to step S280. In step S280, the learning status of the current learning zone is returned from complete to incomplete. Then, the value of the difference amount learning value DEV[i] is updated in the above-described step S250.

In the updating process of the difference amount learning value DEV[i], when the first intake air amount MC1 and the second intake air amount MC2 continue to be constant, the value of the difference amount learning value DEV[i] gradually becomes close to the difference obtained by subtracting the second intake air amount MC2 from the first intake air amount MC1. Thus, in the learning process P7, the amount by which the first intake air amount MC1 differs from the second intake air amount MC2 when the determination process P3 determines that the intake air pulsation is not great is used to update the value of the difference amount learning value DEV[i] such that the value becomes close to the difference amount.

Guard Value Calculation Process

The detail of the guard value calculation process P8 will now be described with reference to FIG. 8. The guard value calculation process P8 calculates, as an upper limit guard value UPPER, the upper limit value of the amount by which the first intake air amount MC1 differs from the second intake air amount MC2 in the current running state of the engine 10. The lower limit value of the difference amount is calculated as a lower limit guard value LOWER. In the present embodiment, the engine rotation speed NE and an engine load KL are used as a state quantity that indicates the running state of the engine 10.

Figure 8:
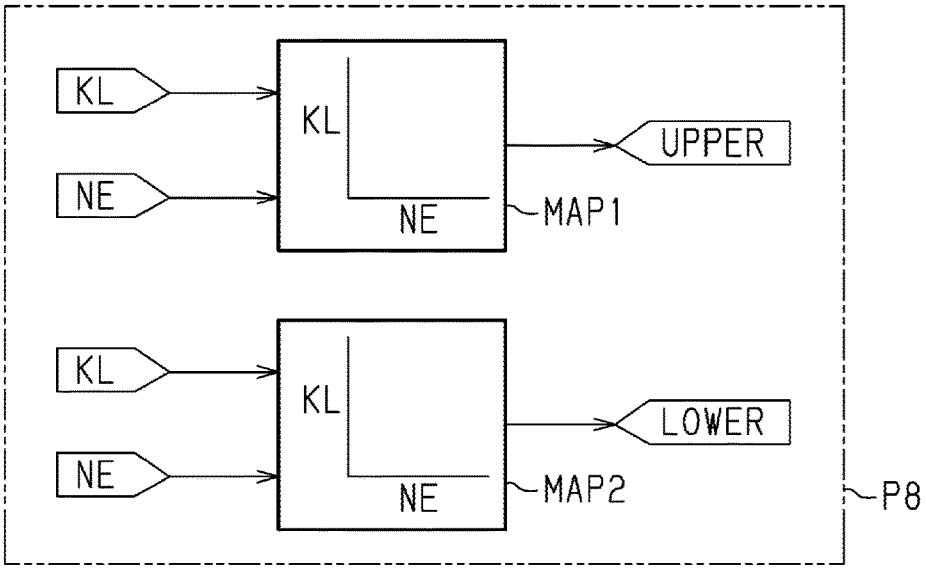
FIG. 8 is a control block diagram of the guard value calculation process executed by the engine controller.

As shown in FIG. 8, in the guard value calculation process P8, a calculation map MAP1, which is stored in advance in the ROM 32 of the engine controller 30, is used to calculate the upper limit guard value UPPER from the engine rotation speed NE and the engine load KL. In the same manner, in the guard value calculation process P8, a calculation map MAP2, which is stored in advance in the ROM 32 of the engine controller 30, is used to calculate the lower limit guard value LOWER from the engine rotation speed NE and the engine load KL. The calculation map MAP1 stores the upper limit value of the above-described difference amount of each running state of the engine 10 indicated by the engine rotation speed NE and the engine load KL. The calculation map MAP2 stores the lower limit value of the above-described difference amount of each running state of the engine 10 indicated by the engine rotation speed NE and the engine load KL.

The amount by which the first intake air amount MC1 differs from the second intake air amount MC2 changes due to the variations in detection characteristics of, for example, the air flow meter 13, the water temperature sensor 34, the intake air temperature sensor 35, and the atmospheric pressure sensor 36 that result from individual differences and changes over time. Further, the amount by which the first intake air amount MC1 differs from the second intake air amount MC2 changes due to the variations in the dimensions and shapes of intake system components of the engine 10 such as the throttle valve 14. Furthermore, the amount by which the first intake air amount MC1 differs from the second intake air amount MC2 changes due to a change in the pressure of exhaust gas such as an increase in the pressure of exhaust gas in the exhaust passage 26. In an engine including an exhaust gas recirculation mechanism that recirculates some of the exhaust gas into intake air, the amount by which the first intake air amount MC1 differs from the second intake air amount MC2 changes due to the variations in the amount of the exhaust gas recirculated by the exhaust gas recirculation mechanism. In an engine including a variable valve mechanism that varies the valve characteristics of the intake valve 24 and the exhaust valve 25, the amount by which the first intake air amount MC1 differs from the second intake air amount MC2 changes due to the variations in variable actuation of the valve characteristics of the variable valve mechanism. The range of the variations in each of these elements is checked in advance when the engine 10 is designed. Further, the range of changes in the difference amount of each running state of the engine 10 that may be caused by these variations is obtained in advance. That is, the upper limit value and the lower limit value of the difference amount stored respectively in the calculation map MAP1 and the calculation map MAP2 are obtained in advance.

Guard Process

Figure 9:
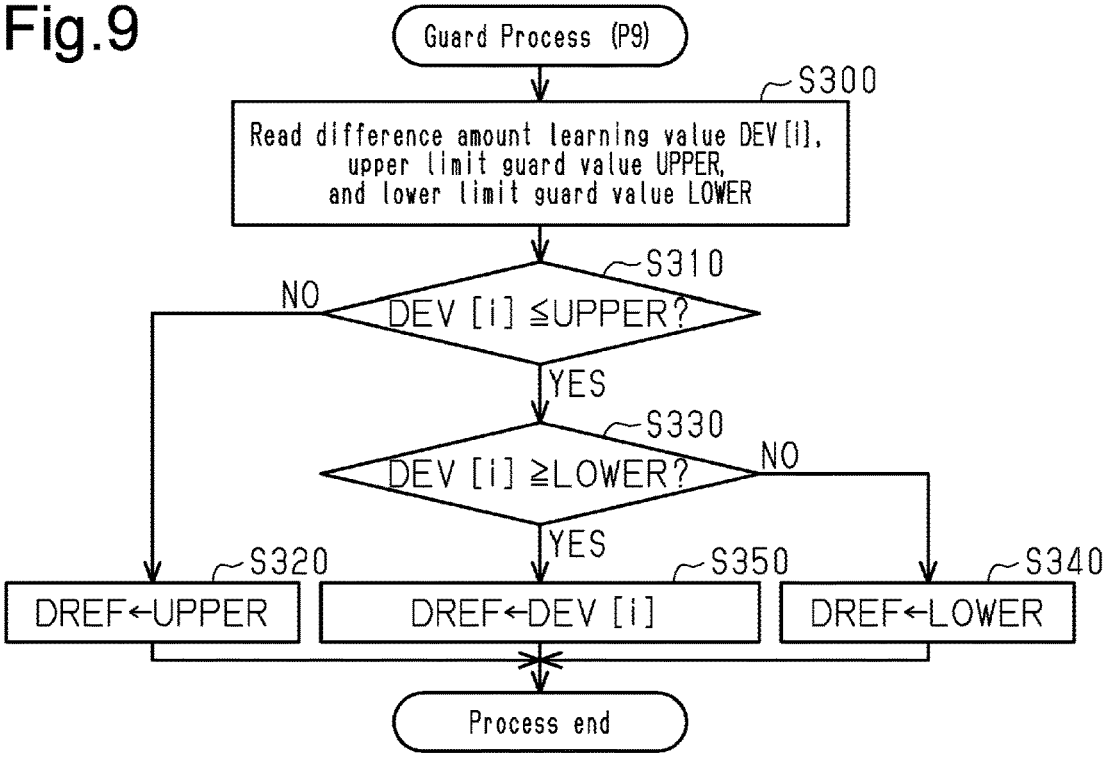
FIG. 9 is a flowchart of the guard process executed by the engine controller.

The detail of the guard process P9 will now be described with reference to FIG. 9. FIG. 9 shows a flowchart of the process related to the upper limit guard and the lower limit guard of the difference amount learning value DEV[i] in the guard process P9.

In the guard process P9, first, in step S300, the difference amount learning value DEV[i] of the current learning zone, the upper limit guard value UPPER, and the lower limit guard value LOWER are read. Then, in step S310, it is determined whether the difference amount learning value DEV[i] of the current learning zone is less than or equal to the upper limit guard value UPPER. When the difference amount learning value DEV[i] of the current learning zone is less than or equal to the upper limit guard value UPPER (S310: YES), the process is advanced to step S330. When the difference amount learning value DEV[i] of the current learning zone is greater than the upper limit guard value UPPER (S310: NO), the process is advanced to step S320. In step S320, the upper limit guard value UPPER is set as the learning reflected value DREF.

When the process is advanced to step S330, it is determined in step S330 whether the difference amount learning value DEV[i] of the current learning zone is greater than or equal to the lower limit guard value LOWER. When the difference amount learning value DEV[i] of the current learning zone is greater than or equal to the lower limit guard value LOWER (S330: YES), the process is advanced to S350. In step S350, the difference amount learning value DEV[i] of the current learning zone is set as the learning reflected value DREF. When the difference amount learning value DEV[i] of the current learning zone is less than the lower limit guard value LOWER (S330: NO), the process is advanced to step S340. In step S340, the lower limit guard value LOWER is set as the learning reflected value DREF.

Thus, in the guard process P9, when the difference amount learning value DEV[i] is greater than the upper limit guard value UPPER, the upper limit guard value UPPER is set as the learning reflected value DREF. When the difference amount learning value DEV[i] is less than the lower limit guard value LOWER, the lower limit guard value LOWER is set as the learning reflected value DREF. When the difference amount learning value DEV[i] is less than or equal to the upper limit guard value UPPER and greater than or equal to the lower limit guard value LOWER, the difference amount learning value DEV[i] is set as the learning reflected value DREF. As described above, when the determination process P3 determines that the intake air pulsation is great, the calculation method switching process P4 sets the sum of the second intake air amount MC2 and the learning reflected value DREF as the intake air amount calculation value MC.

The operation of the present embodiment will now be described.

As described above, in the intake passage 11 of the engine 10, when the intake valve 24 intermittently opens, the pulsation of intake air occurs. For example, when the engine 10 is running with high load, the intake air pulsation is great. This affects the detection result of the air flow meter 13, lowering the detection accuracy of the AFM-detected intake air flow rate GA obtained by the air flow meter 13. Thus, in the mass flow method, whereas the intake air amount is calculated correctly when the intake air pulsation is small, the intake air amount is not calculated correctly when the intake air pulsation is great. In the present embodiment, whereas the intake air amount is calculated by the mass flow method when the intake air pulsation is small, the method for calculating the intake air amount is switched from the mass flow method to the throttle speed method when the intake air pulsation is great.

However, the throttle speed method cannot calculate the intake air amount as accurately as the mass flow method when the intake air pulsation is small. In the present embodiment, when the intake air pulsation is small, the amount by which the calculated value of the intake air amount obtained by the throttle speed method differs from the calculated value of the intake air amount obtained by the mass flow method is learned as the difference amount learning value DEV[i]. When the intake air pulsation is great, the value obtained by reflecting the result of learning the difference amount on the second intake air amount MC2, which is the value of the intake air amount calculated by the throttle speed method, is set as the intake air amount calculation value MC. This ensures the calculation accuracy of the intake air amount.

While the learning of the difference amount learning value DEV[i] is done when the intake air pulsation is small, the reflection of the difference amount learning value DEV [i] on the intake air amount calculation value MC is done when the intake air pulsation is great. Thus, when the difference amount learning value DEV[i] is reflected on the intake air amount calculation value MC, the difference amount learning value DEV[i] may be learned in a different running state. The range of possible values of the difference amount changes depending on the running state of the engine 10. Thus, when the intake air pulsation is great, reflecting the difference amount learning value DEV[i] on the intake air amount calculation value MC, with the difference amount learning value DEV[i] unchanged, may result in the following problem. That is, when the difference amount learning value DEV[i] is learned in a running state in which the difference is large between the first intake air amount MC1 and the second intake air amount MC2, reflecting the difference amount learning value DEV[i] on the calculation of the intake air amount in a running state in which the different is not so large may lower the calculation accuracy of the intake air amount calculation value MC.

In the present embodiment, the range of possible values of the difference amount in each running state of the engine 10 is obtained in advance. When the intake air pulsation is great, the learning result of the difference amount is reflected on the intake air amount calculation value MC within the range of possible values of the difference amount. Thus, even when the difference amount learning value DEV[i] is learned in the running state in which the difference is large between the first intake air amount MC1 and the second intake air amount MC2, a decrease is limited in the calculation accuracy of the intake air amount calculation value MC caused by the reflection of the difference amount learning value DEV[i].

The engine controller 30 of the present embodiment has the following advantages.

(1) When the detection accuracy of the air flow meter 13 is lowered due to an increase in the intake air pulsation, the method of calculating the intake air amount is switched from the mass flow method, which uses the detected value of the air flow meter 13, to the throttle speed method, which does not use the detected value. This limits a decrease in the calculation accuracy of the intake air amount caused by the intake air pulsation. Consequently, this limits a decrease in the accuracy of the fuel injection amount control executed using the calculated value of the intake air amount.

(2) When the intake air pulsation is small, the amount by which the first intake air amount MC1 differs from the second intake air amount MC2 is learned. The learning result is reflected on the calculation of the intake air amount when the intake air pulsation is great. Accordingly, the calculation accuracy of the intake air amount when the intake air pulsation is great is increased as compared with when, for example, the intake air amount is calculated simply by the throttle speed method.

(3) The range of possible values of the difference amount in each running state of the engine 10 is obtained in advance. When the intake air pulsation is great, the learning result of the difference amount is reflected on the intake air amount calculation value MC within the range of the values. Thus, even when the difference amount learning value DEV[i] is learned in the running state in which the difference is large between the first intake air amount MC1 and the second intake air amount MC2, a decrease is limited in the calculation accuracy of the intake air amount calculation value MC caused by the reflection of the difference amount learning value DEV[i].

The present embodiment may be modified as follows. The present embodiment and the following modifications can be combined as long as the combined modifications remain technically consistent with each other.

Figure 10:
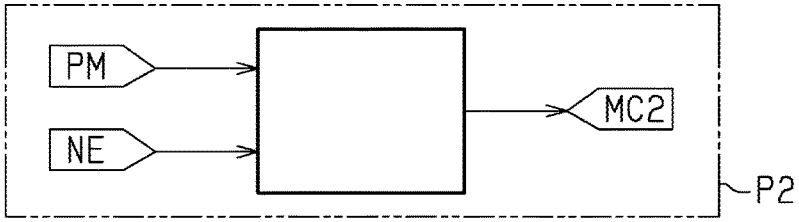
FIG. 10 is a control flow diagram of the second calculation process in a modification of the engine controller.

In the second calculation process P2 of the above-described embodiment, the second intake air amount MC2 is calculated by the throttle speed method, which is based on the throttle opening degree TA and the engine rotation speed NE. Instead, as shown in FIG. 10, in the second calculation process P2, the second intake air amount MC2 may be calculated by the speed density method, which is based on the intake pipe pressure PM and the engine rotation speed NE. Even in such a case, when the detection accuracy of the air flow meter 13 is lowered due to an increase in the intake air pulsation, the intake air amount is calculated without using the detected value of the air flow meter 13.

Figure 11:
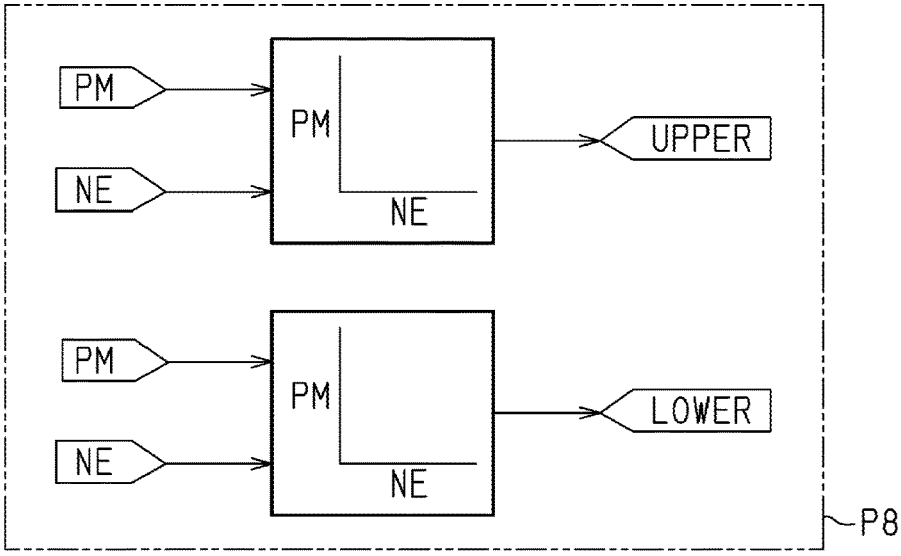
FIG. 11 is a control flow diagram of the guard value calculation process in another modification of the engine controller.
Figure 12:
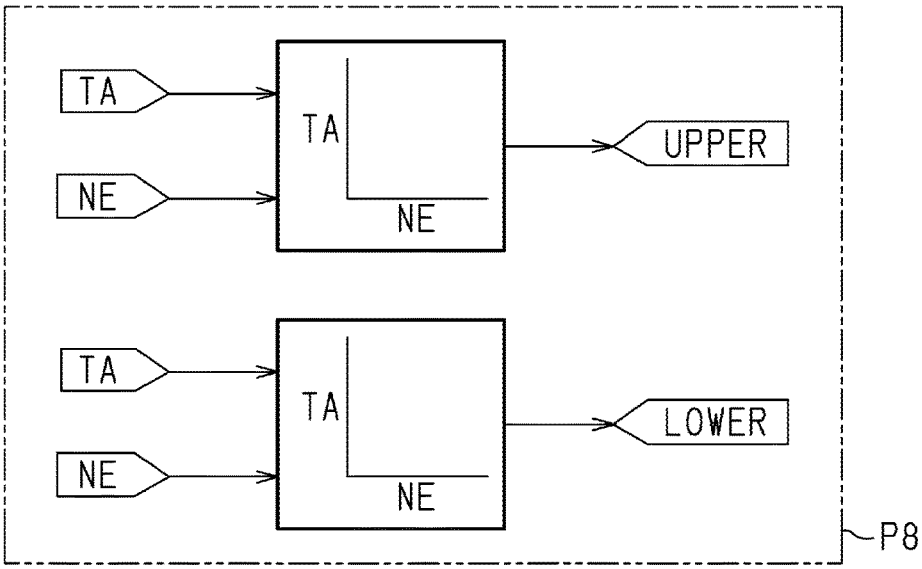
FIG. 12 is a control flow diagram of the guard value calculation process in a further modification of the engine controller.
Figure 13:
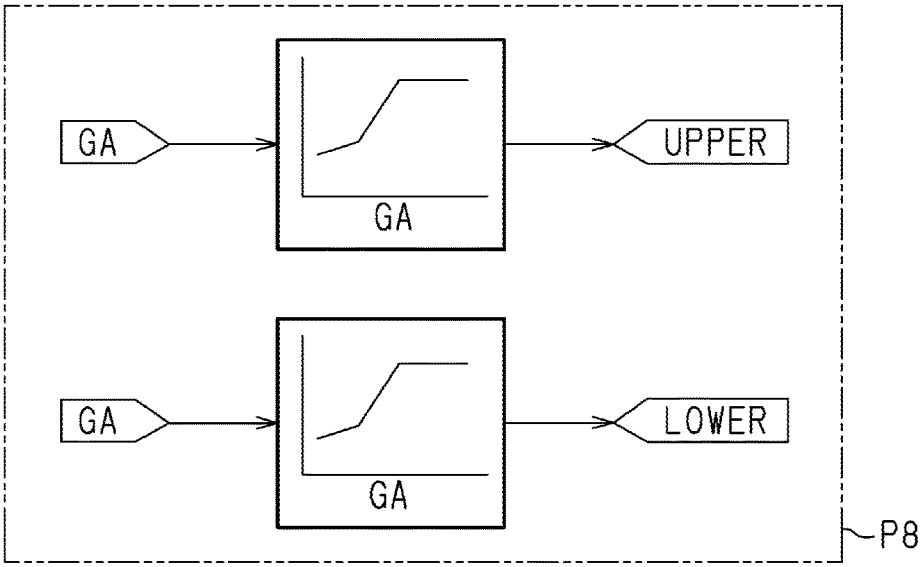
FIG. 13 is a control flow diagram of the guard value calculation process in yet another modification of the engine controller.

In the guard value calculation process P8 of the above-described embodiment, the upper limit guard value UPPER and the lower limit guard value LOWER are calculated using the engine load KL and the engine rotation speed NE as the state quantity that indicates the running state of the engine 10. Instead, as shown in FIG. 11, in the guard value calculation process P8, the upper limit guard value UPPER and the lower limit guard value LOWER may be calculated using the intake pipe pressure PM and the engine rotation speed NE as the state quantity that indicates the running state of the engine 10. Alternatively, as shown in FIG. 12, in the guard value calculation process P8, the upper limit guard value UPPER and the lower limit guard value LOWER may be calculated using the throttle opening degree TA and the engine rotation speed NE as the state quantity that indicates the running state of the engine 10. As another option, as shown in FIG. 13, in the guard value calculation process P8, the upper limit guard value UPPER and the lower limit guard value LOWER may be calculated using the AFM-detected intake air flow rate GA as the state quantity that indicates the running state of the engine 10.

The determination process P3 determines whether the intake air pulsation is great based on the pulsation ratio RTE, which is calculated from the AFM-detected intake air flow rate GA. However, the determination does not have to be made in this manner. Instead, for example, the determination may be made in reference to whether the difference obtained by subtracting the minimum value GMIN from the maximum value GMAX is greater than or equal to a preset determined value. Alternatively, it may be determined whether the intake air pulsation is great by making the above-described determination based on the running state of the engine 10, for example, the engine rotation speed NE or an estimated intake air amount.

The modes of setting the difference amount learning zone are not limited to the above-described examples and may be changed.

The engine controller 30 is not limited to a device that includes the CPU 31 and the ROM 32 and executes software processing. For example, at least part of the processes executed by the software in the above-illustrated embodiment may be executed by hardware circuits dedicated to executing these processes (such as ASIC). That is, the engine controller may be modified as long as it has any one of the following configurations (a) to (c): (a) a configuration including a processor that executes all of the above-described processes according to programs and a program storage device such as a ROM (that may include a non-transitory computer readable medium) that stores the programs; (b) a configuration including a processor and a program storage device that execute part of the above-described processes according to the programs and a dedicated hardware circuit that executes the remaining processes; and (c) a configuration including a dedicated hardware circuit that executes all of the above-described processes. A plurality of software execution devices each including a processor and a program storage device and a plurality of dedicated hardware circuits may be provided.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. An engine controller that calculates an intake air amount of an engine and executes a fuel injection control of an injector by determining a fuel injection amount based on a calculated value of the intake air amount, wherein the engine controller is configured to execute:

a first calculation process that calculates the intake air amount based on a detected value of an intake air flow rate obtained by an air flow meter;

a second calculation process that calculates the intake air amount based on one of a detected value of an intake pipe pressure and a throttle opening degree without using the detected value of the intake air flow rate;

a determination process that determines whether an intake air pulsation in an intake passage of the engine is great;

a learning process that updates a difference amount learning value based on a difference amount by which a first intake air amount differs from a second intake air amount such that the difference amount learning value becomes close to the difference amount when the determination process determines that the intake air pulsation is not great, the first intake air amount being the calculated value of the intake air amount obtained by the first calculation process, the second intake air amount being the calculated value of the intake air amount obtained by the second calculation process;

a guard value calculation process that calculates an upper limit guard value and a lower limit guard value based on a state quantity that indicates a running state of the engine;

a guard process that sets the upper limit guard value as a learning reflected value when the difference amount learning value is greater than the upper limit guard value, sets the lower limit guard value as the learning reflected value when the difference amount learning value is less than the lower limit guard value, and sets the difference amount learning value as the learning reflected value when the difference amount learning value is less than or equal to the upper limit guard value and greater than or equal to the lower limit guard value; and a calculation method switching process that sets the first intake air amount as the calculated value of the intake air amount when the determination process determines that the intake air pulsation is not great and sets a sum of the second intake air amount and the learning reflected value as the calculated value of the intake air amount when the determination process determines that the intake air pulsation is great.

2. The engine controller according to claim 1, wherein an engine rotation speed and an engine load are set as the state quantity.

3. The engine controller according to claim 1, wherein an engine rotation speed and the intake pipe pressure are set as the state quantity.

4. The engine controller according to claim 1, wherein an engine rotation speed and the throttle opening degree are set as the state quantity.

5. The engine controller according to claim 1, wherein the intake air flow rate is set as the state quantity.

6. An engine control method that calculates an intake air amount of an engine and executes a fuel injection control of an injector by determining a fuel injection amount based on a calculated value of the intake air amount, the engine control method comprising:

calculating the intake air amount based on a detected value of an intake air flow rate obtained by an air flow meter;

calculating the intake air amount based on one of a detected value of an intake pipe pressure and a throttle opening degree without using the detected value of the intake air flow rate;

determining that determines whether an intake air pulsation in an intake passage of the engine is great;

updating a difference amount learning value based on a difference amount by which a first intake air amount differs from a second intake air amount such that the difference amount learning value becomes close to the difference amount when it is determined that the intake air pulsation is not great, the first intake air amount being the calculated value of the intake air amount obtained by calculation based on the detected value of the intake air flow rate, the second intake air amount being the calculated value of the intake air amount obtained by calculation based on one of the detected value of the intake pipe pressure and the throttle opening degree;

calculating an upper limit guard value and a lower limit guard value based on a state quantity that indicates a running state of the engine;

setting the upper limit guard value as a learning reflected value when the difference amount learning value is greater than the upper limit guard value;

setting the lower limit guard value as the learning reflected value when the difference amount learning value is less than the lower limit guard value;

setting the difference amount learning value as the learning reflected value when the difference amount learning value is less than or equal to the upper limit guard value and greater than or equal to the lower limit guard value; and setting the first intake air amount as the calculated value of the intake air amount when it is determined that the intake air pulsation is not great; and setting a sum of the second intake air amount and the learning reflected value as the calculated value of the intake air amount when it is determined that the intake air pulsation is great.

7. A non-transitory computer readable memory medium that stores a program that causes a processor to execute an engine control process, the engine control process calculating an intake air amount of an engine and executing a fuel injection control of an injector by determining a fuel injection amount based on a calculated value of the intake air amount, the engine control process comprising:

calculating the intake air amount based on a detected value of an intake air flow rate obtained by an air flow meter;

calculating the intake air amount based on one of a detected value of an intake pipe pressure and a throttle opening degree without using the detected value of the intake air flow rate;

determining that determines whether an intake air pulsation in an intake passage of the engine is great;

updating a difference amount learning value based on a difference amount by which a first intake air amount differs from a second intake air amount such that the difference amount learning value becomes close to the difference amount when it is determined that the intake air pulsation is not great, the first intake air amount being the calculated value of the intake air amount obtained by calculation based on the detected value of the intake air flow rate, the second intake air amount being the calculated value of the intake air amount obtained by calculation based on one of the detected value of; the intake pipe pressure and the throttle opening degree;

calculating an upper limit guard value and a lower limit guard value based on a state quantity that indicates a running state of the engine;

setting the upper limit guard value as a learning reflected value when the difference amount learning value is greater than the upper limit guard value;

setting the lower limit guard value as the learning reflected value when the difference amount learning value is less than the lower limit guard value;

setting the difference amount learning value as the learning reflected value when the difference amount learning value is less than or equal to the upper limit guard value and greater than or equal to the lower limit guard value; and setting the first intake air amount as the calculated value of the intake air amount when it is determined that the intake air pulsation is not great; and setting a sum of the second intake air amount and the learning reflected value as the calculated value of the intake air amount when it is determined that the intake air pulsation is great.

* * * * *